US008138133B2

(12) United States Patent
Suzuki et al.

(10) Patent No.: US 8,138,133 B2
(45) Date of Patent: Mar. 20, 2012

(54) GEAR OIL COMPOSITION

(75) Inventors: Yasuyoshi Suzuki, Saitama (JP); Narihiko Yoshimura, Saitama (JP); Kenji Ueno, Aichi (JP); Kouji Saitoh, Aichi (JP); Tatsuji Suganuma, Aichi (JP); Kiyonari Ishikawa, Aichi (JP)

(73) Assignee: ExxonMobil Research and Engineering Company, Annandale, NJ (US)

( * ) Notice: Subject to any disclaimer, the term of this patent is extended or adjusted under 35 U.S.C. 154(b) by 836 days.

(21) Appl. No.: 11/492,360

(22) Filed: Jul. 25, 2006

(65) Prior Publication Data

US 2007/0027042 A1 Feb. 1, 2007

(30) Foreign Application Priority Data

Jul. 29, 2005 (JP) ..... 2005-222238

(51) Int. Cl.
*C10M 135/02* (2006.01)
*C10M 141/10* (2006.01)
*C10M 169/04* (2006.01)

(52) U.S. Cl. ..... 508/337; 508/110; 508/569; 508/421

(58) Field of Classification Search ..... 508/337, 508/110, 421, 569
See application file for complete search history.

(56) References Cited

U.S. PATENT DOCUMENTS

| | | | | |
|---|---|---|---|---|
| 5,652,201 | A * | 7/1997 | Papay et al. | 508/228 |
| 2003/0207775 | A1 * | 11/2003 | Sullivan et al. | 508/463 |
| 2004/0147410 | A1 * | 7/2004 | Milner et al. | 508/195 |
| 2005/0090410 | A1 * | 4/2005 | Devlin et al. | 508/438 |

FOREIGN PATENT DOCUMENTS

WO WO 2004074414 A1 * 9/2004

* cited by examiner

*Primary Examiner* — Jim Goloboy
(74) *Attorney, Agent, or Firm* — Robert A. Migliorini

(57) ABSTRACT

The present invention provides a gear oil composition for vehicle driving systems, more specifically a gear oil composition for vehicle final reduction gears, which can improve a fuel-saving effect by reducing its viscosity and, at the same time, secure bearing fatigue life characteristics.

The gear oil composition comprises a base oil (A) and another base oil (B), described below, and at least one species of additive for gear oil, and has a kinematic viscosity of 80 $mm^2/s$ or less at 40° C.:

(A): a mineral-based oil and/or hydrocarbon-based synthetic oil having a kinematic viscosity of 3.5 to 7 $mm^2/s$ at 100° C., and (B): a mineral-based oil and/or hydrocarbon-based synthetic oil having a kinematic viscosity of 20 to 52 $mm^2/s$ at 100° C.

9 Claims, 1 Drawing Sheet

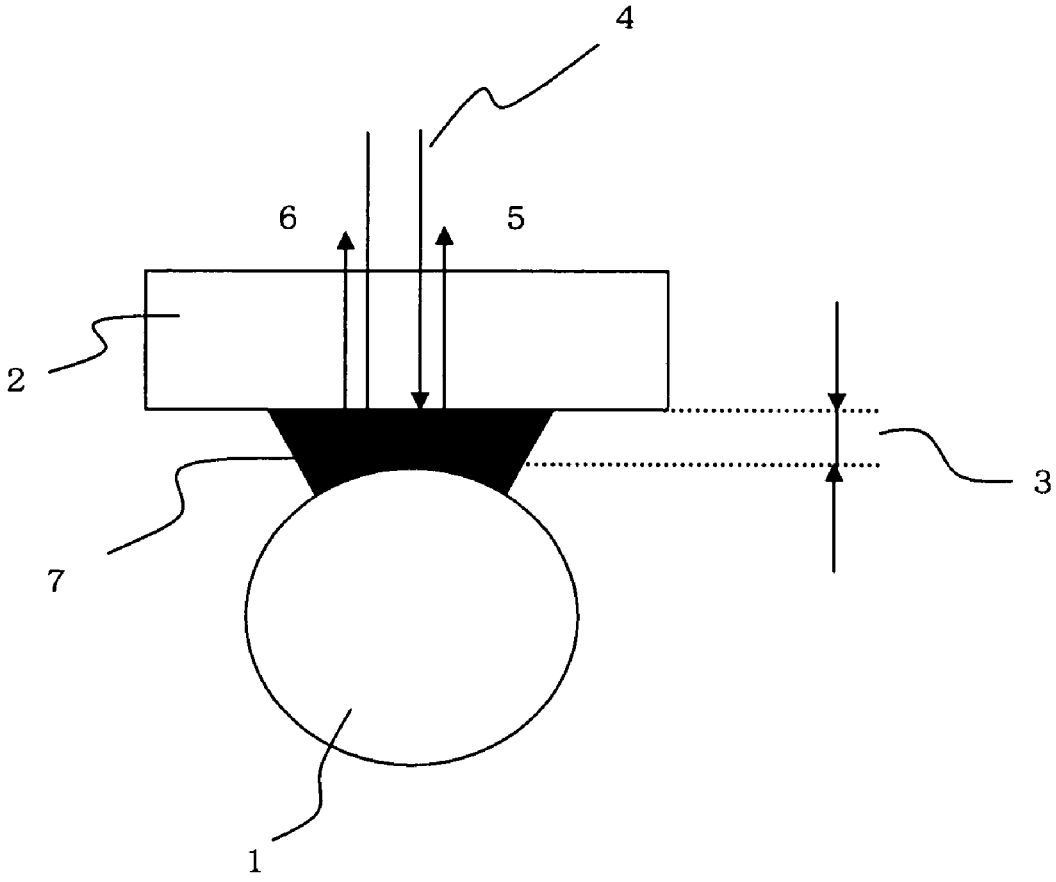
4
6
5
2
3
7
1

GEAR OIL COMPOSITION

This Application relates and claims priority to Japanese Patent Application No. JP 2005-222238 filed Jul. 29, 2005.

FIELD OF THE INVENTION

The present invention relates to a gear oil composition, more specifically a gear oil composition for vehicle driving systems, in particular that for final reduction gears.

DESCRIPTION OF THE RELATED ART

Recently, development/establishment of the fuel-saving technologies which contribute to abatement of global environmental load materials exhausted from vehicles and other engines and also to reduction of fuel consumption are becoming more and more important, as measures for preservation of global environments are becoming unavoidable issues. For various vehicle lubricating oils, efforts are extensively directed to reduction of viscosity and friction to improve mileage.

In these efforts to improve mileage, it is an important premise for a lubricating oil to retain its existing performance characteristics, even when it is reduced in viscosity. For example, it is essential for a vehicle gear oil as one of lubricating oils for vehicle driving systems, in particular that for final reduction gears, to keep load resistance characteristics, beginning with extreme-pressure characteristics and wear resistance, as will be understood.

More specifically, a final reduction gear (differential gear), which is mounted in a vehicle driving system together with a transmission, has two functions; (1) function of further reducing power which has been reduced by a transmission and deflecting the reduced power at a right angle, and (2) differential function for securing smooth driving of a vehicle even when its right and left drive wheels rotate at a different speed, which occurs when a vehicle turns. A hypoid gear used as a gear transmission mechanism for a final reduction gear is exposed to severe conditions and needs a gear oil which can work under severe lubricating conditions, e.g., high speed and high load. Therefore, a gear oil for hypoid gears must have excellent load resistance characteristics (e.g., resistance to seizure and friction). Reduction of viscosity should be achieved on the premise that it retains capability of forming an oil film between gears, accordingly.

It is therefore necessary to achieve mileage improvement by reducing gear oil viscosity on the premise that it still retains high-temperature characteristics not affected by the reduction. For this reason, it should have a certain viscosity necessary to form and retain an oil film at high temperature.

A lubricating oil has been generally incorporated with a viscosity index improver to secure a certain viscosity at high temperature. However, a viscosity index improver involves a problem that it cannot secure an oil film thicker than expected, because a high-molecular-weight polymer as a viscosity index improver component tends to be oriented under high shear stress conditions.

As a result, lubricating oils of reduced viscosity have not been commercialized for final reduction gears, and most of the commercial ones have a kinematic viscosity of 85 $mm^2/s$ or more at 40° C., and no lubricating oil having a kinematic viscosity reduced to 80 $mm^2/s$ or less is commercially available for final reduction gears.

In consideration of these situations, Patent Document 1 (Japanese Patent No. 2,555,284 Gazette) proposes a lubricating oil composition comprising (A) a mineral-based base oil having fluidity at low temperature (kinematic viscosity of 1.5 to 50 cSt at 100° C. and pour point of −30° C. or lower), (B) 0.5 to 20% by mass of an ethylene-α-olefin copolymer having a number-average molecular weight of 2,000 to 8,000, and (C) an extreme-pressure agent, wear resistance improver, oiliness improver and detergent additive, as a lubricating oil of improved temperature-related characteristics which can prevent reduction of permanent viscosity of multi-grade oil incorporated with a viscosity index improver, keep a certain viscosity at high temperature and have a low viscosity even at low temperature.

However, the lubricating oil composition disclosed by the Patent Document 1 contains an ethylene-α-olefin copolymer as the component B which has a high number-average molecular weight of 2,000 to 8,000. A copolymer having a number-average molecular weight of 3600 has a kinematic viscosity of 200 $mm^2/s$ or more, as described in EXAMPLES. A lubricating oil composition containing an ethylene-α-olefin copolymer having such a high molecular weight involves a problem of difficulty in securing bearing fatigue life characteristics due to its insufficient capability of forming an oil film.

Use of a molybdenum-based friction modifier and polymethacrylate-based viscosity index improver has been studied as an energy-saving technique, noting a possibility of reduced friction even after the lubricating oil composition incorporated with them is deteriorated by oxidation (Patent Document 2 (Japanese Patent No. 2,906,024 Gazette)). However, many friction modifiers have a drawback of insufficient durability. Therefore, use of a friction modifier for saving fuel is considered to involve many problems to be solved.

These situations have been keenly requiring development of gear oils for vehicle driving systems, in particular final reduction gears, which can secure an oil film at high temperature and keep bearing fatigue life characteristics even when they are reduced in viscosity, knowing that reduction of lubricating oil viscosity is one of the most effective measures for fuel saving.

DISCLOSURE OF THE INVENTION

In one embodiment, it is an object of the present invention to provide a gear oil composition, more specifically a gear oil composition for vehicle driving systems, in particular final reduction gears, which can improve a fuel-saving effect by reducing its viscosity and, at the same time, secure bearing fatigue life characteristics.

The inventors of the present invention have found, after having extensively studied to solve the above problems, that the above object can be accomplished by a gear oil composition which comprises 2 or more species of base oils of different viscosity, more specifically a low-viscosity base oil composed of a mineral-based oil and/or hydrocarbon-based synthetic oil having a kinematic viscosity specified at 3.5 to 7 $mm^2/s$ at 100° C. and high-viscosity base oil composed of a mineral-based oil and/or hydrocarbon-based synthetic oil having a kinematic viscosity specified at 20 to 52 $mm^2/s$ at 100° C., and has a specific kinematic viscosity at 40° C., achieving the present invention.

The present invention provides a gear oil composition which comprises a base oil (A) and another base oil (B), described below, and at least one species of additive for gear oil, and has a kinematic viscosity of 80 $mm^2/s$ or less at 40° C.:

(A): a mineral-based oil and/or hydrocarbon-based synthetic oil having a kinematic viscosity of 3.5 to 7 $mm^2/s$ at 100° C., and (B) a mineral-based oil and/or hydrocarbon-based synthetic oil having a kinematic viscosity of 20 to 52 $mm^2/s$ at 100° C.

The present invention also provides a base oil for gear oil composition, which contains (A) a mineral-based oil and/or hydrocarbon-based synthetic oil having a kinematic viscosity 3.5 to 7 $mm^2/s$ at 100° C., and (B) a mineral-based oil and/or hydrocarbon-based synthetic oil having a kinematic viscosity of 20 to 52 $mm^2/s$ at 100° C.

The present invention also provides a method for reducing fuel consumption at vehicle final reduction gears by use of the gear oil composition which contains (A) a mineral-based oil and/or hydrocarbon-based synthetic oil having a kinematic viscosity 3.5 to 7 $mm^2/s$ at 100° C. and (B) a mineral-based oil and/or hydrocarbon-based synthetic oil having a kinematic viscosity of 20 to 52 $mm^2/s$ at 100® C., and has a kinematic viscosity of 80 $mm^2/s$ or less at 40° C.

The gear oil composition of the present invention, which is for vehicle gears and in particular for final reduction gears, is composed of a combination of at least 2 species of base oils each having a viscosity in the above-described range and has a specific kinematic viscosity reduced to 80 $mm^2/s$ or less at 40° C., as described above. This composition brings an advantage of improving fuel saving effect while keeping good bearing fatigue life characteristics which tend to conflict with a fuel saving effect.

The present invention comprises a high-viscosity base oil composed of a mineral-based oil and/or hydrocarbon-based synthetic oil to contain specific high-viscosity components, and a low-viscosity base oil composed of a mineral-based oil and/or hydrocarbon-based synthetic oil, to expand the molecular weight distribution range. This composition can bring a high viscosity index effect of keeping a high viscosity at high temperature to achieve fuel saving by viscosity reduction. At the same time, it can form and retain an oil film of sufficient thickness to keep the so-called fluid lubrication condition on a friction surface.

Increased oil film thickness to a sufficient extent can protect a friction surface from damages, to greatly improve bearing fatigue life characteristics.

In one embodiment, the present invention provides a gear oil composition of reduced viscosity, comprising a high-viscosity base oil having a specific kimematic viscosity, which is diluted with a low-viscosity base oil to an extent that the composition has a kinematic viscosity of 80 $mm^2/s$ or less at 40° C., as described above. The preferred embodiments of the present invention include the following items 1) to 8).

1) The above-described gear oil composition, wherein difference between the low-viscosity base oil and high-viscosity base oil in kinematic viscosity at 100° C. is 13 $mm^2/s$ or more.

2) The above-described gear oil composition, wherein the low-viscosity base oil comprises one or more species of mineral-based oil and/or hydrocarbon-based synthetic oil composed of poly-α-olefin or ethylene-α-olefin copolymer having a kinematic viscosity of 3.5 to 7 $mm^2/s$ at 100° C.

3) The above-described gear oil composition, wherein the high-viscosity base oil comprises one or more species of hydrocarbon-based synthetic oil composed of poly-α-olefin and/or ethylene-α-olefin copolymer having a kinematic viscosity of 20 to 52 $mm^2/s$ at 100° C.

4) The above-described gear oil composition which is incorporated with at least one species of additive selected from the group consisting of sulfur-based additive, phosphorus-based additive, ashless dispersant, pour point depressant, antifoaming agent, antioxidant, rust inhibitor and friction modifier.

5) The above-described gear oil composition which is incorporated with at least one species of extreme-pressure additive selected from the group consisting of sulfur-based one and phosphorus-based one, and at least one species of additive selected from the group consisting of ashless dispersant, pour point depressant, antifoaming agent, antioxidant, rust inhibitor, corrosion inhibitor and friction modifier.

6) The above-described gear oil composition, wherein the sulfur-based additive is of a sulfided olefin, and phosphorus-based additive is of an alkylamine salt of acidic phosphoric acid ester and/or acidic phosphorous acid ester.

7) The above-described gear oil composition which is further incorporated with an ester-based solubilizing agent.

8) The above-described gear oil composition which is used for vehicle final reduction gears.

The constituent components of the gear oil composition of the present invention are described in detail:

The gear oil composition of the present invention is a mixture of (A) a low-viscosity base oil and (B) a high-viscosity base oil, and (C) one or more additives for gear oil as required, where these components are incorporated in a controlled ratio to have a composition kinematic viscosity not exceeding 80 $mm^2/s$ at 40° C. It has a kinematic viscosity controlled at 80 $mm^2/s$ or less at 40° C., preferably 70 to 80 $mm^2/s$, particularly preferably 70 to 76 $mm^2/s$ to improve fuel saving effect.

The base oil for the gear oil composition of the present invention comprises (B) a high-viscosity base oil having a kinematic viscosity of 20 to 52 $mm^2/s$ at 100° C., diluted with (A) a low-viscosity base oil having a kinematic viscosity of below 20 $mm^2/s$ at 100° C., preferably 3.5 to 7 $mm^2/s$, to an extent that the composition comprising the components (A), (B) and (C) has a kinematic viscosity of 80 $mm^2/s$ or less at 40° C.

The gear oil composition of the present invention can have a desired composition when the mixing ratio of (B) low-viscosity base oil to (A) high-viscosity base oil is set by a common lubricating oil blending procedure while considering viscosity of each component, because the additive has a limited effect on composition viscosity, as discussed later.

The gear oil composition of the present invention is developed based on the findings that a combination of a low-viscosity base oil and high-viscosity base oil of different kinematic viscosity at 100° C. expands molecular weight distribution range of the composition, bringing advantages of high viscosity index effect of keeping a high viscosity at high temperature, and formation of oil film of sufficient thickness to keep the fluid lubrication condition on a friction surface to prevent its damages. A preferable difference between the low-viscosity base oil and high-viscosity base oil in kinematic viscosity at 100° C. is 13 to 48.5 $mm^2/s$, more preferably 13.5 to 43.5 $mm^2/s$, viewed from improvement of both viscosity index and bearing fatigue life characteristics. The difference of 50 $mm^2/s$ or more is observed to deteriorate bearing fatigue life characteristics, although having little effect on viscosity index.

The high-viscosity base oil to be blended with the low-viscosity base oil has a kinematic viscosity at 100° C. in a specific range unforeseen by conventional techniques to realize expression of high viscosity index and increased oil film thickness, and thereby to simultaneously satisfy fuel saving effect and bearing fatigue life characteristics.

It is also found that increased oil film thickness in a fluid lubrication condition can avoid damages of a friction surface, and improve bearing fatigue life characteristics and load resistance characteristics (e.g., extreme-pressure characteristics and wear resistance) required for a gear oil.

The preferable low-viscosity base oil is composed of a mineral-based oil and/or hydrocarbon-based synthetic oil having a kinematic viscosity of 7 $mm^2/s$ or less at 100° C., particularly preferably 3.5 to 7 $mm^2/s$. Incorporation of a low-viscosity base oil having a kinematic viscosity above 7 $mm^2/s$ at 100° C. may deteriorate fuel-saving effect of the gear oil composition. When it has a kinematic viscosity below 3.5 $mm^2/s$ at 100° C., on the other hand, the composition may not have a sufficient viscosity index at high temperature, possibly failing to express an effect of mixing base oils of different viscosity and exhibiting deteriorated bearing fatigue life characteristics.

The preferable high-viscosity base oil is composed of a hydrocarbon-based synthetic oil having a kinematic viscosity of 20 to 52 $mm^2/s$ at 100° C., more preferably 20 to 40 $mm^2/s$. The synthetic oil is particularly preferably composed of a poly-α-olefin and ethylene-α-olefin copolymer. The gear oil composition, when incorporated with a high-viscosity base oil having a kinematic viscosity below 20 $mm^2/s$ at 100° C., may not form an oil film of sufficient thickness, possibly failing to exhibit sufficient bearing fatigue life characteristics. Incorporation of a high-viscosity base oil having a kinematic viscosity above 52 $mm^2/s$ at 100° C., on the other hand, the composition may have an unexpectedly deteriorated oil film forming capability, possibly failing to secure bearing fatigue life characteristics.

Various base oils for preparation of the low-viscosity and high-viscosity base oils are described below. The mineral-based base oils (including GTL-based one) useful for the low-viscosity and high-viscosity base oils include vacuum distillates of paraffinic, intermediate and naphthenic crudes as lubricating oil fractions treated by one or more processes selected from solvent refining, hydrocracking, hydrotreating, hydrorefining, solvent dewaxing, catalytic dewaxing, clay treatment and so forth; deasphalted oils produced by solvent deasphalting and treated by one or more of the above processes; mineral-based oils produced by wax isomerization; and a mixture thereof.

GTL-based base oils include lubricating oil fractions separated from liquid products produced from natural gas or the like as a starting material, and lubricating oil fractions produced by hydrocracking of produced wax. Lubricating oil fractions separated from liquid products produced by an asphalt-to-liquid (ATL) process which treats heavy residue fractions, e.g., asphalt, are also useful as the base oils for the present invention.

The solvent refining process uses an aromatic extractant, e.g., phenol, furfural, or N-methyl-2-pyrrolidone. The solvent dewaxing process uses a solvent, e.g., liquefied propane or methylethylketone (MEK)/toluene. The catalytic dewaxing process uses a dewaxing catalyst, e.g., shape-selective zeolite.

The above-described mineral-based base oils are provided as light neutral, intermediate neutral or heavy neutral oils, bright stocks, or the like depending on their viscosity level.

On the other hand, synthetic base oils may be selected from hydrocarbon-based ones, including the hydrocarbon-based polymers and copolymers listed below:

Poly-α-olefins:

The poly-α-olefins useful for the present invention include poly-1-hexene, poly-1-octene, poly-1-decene and a mixture thereof. The monomers for the poly-α-olefins are not limited to the above, but normally include olefins of 4 to 10 carbon atoms, which may be used either individually or in combination as polymerization feed stocks.

Polybutene:

Ethylene-α-olefin Copolymer:

The ethylene-α-olefin copolymers useful for the present invention include copolymers of ethylene and α-olefin copolymer of 3 to 20 carbon atoms, such as propylene, 1-butene, 1-octene or 1-decene. These copolymers may be used either individually or in combination.

These synthetic oils are hydrocarbon-based ones of low polymerization degree, with a desired viscosity which can be realized by controlling polymerization degree. Those having a kinematic viscosity of around 10 to 3000 $mm^2/s$ at 100° C. are commercially available, and the low-viscosity and high-viscosity base oils for the present invention may be selected from these products having an adequate viscosity.

Starting materials for the synthetic base oils include alkylbenzene (dodecylbenzene, tetradecylbenzene, di(2-ethylhexyl)benzene and dinonylbenzene); polyphenyl (e.g., biphenyl and alkylated polyphenyl); and alkylated diphenyl ether, alkylated diphenyl sulfide and a derivative thereof).

The particularly preferable low-viscosity base oils as a component of the gear oil composition of the present invention include a mineral-based oil produced by solvent refining, hydrotreating or the like, and hydrocarbon-based synthetic oil, e.g., poly-α-olefin (PAO) or ethylene-α-olefin copolymer (EAO), having a kinematic viscosity of 3.5 to 7 $mm^2/s$ at 100° C., of which a mineral-based oil is more preferable viewed from economic efficiency.

The high-viscosity base oil may be a mineral-base of hydrocarbon-based synthetic one, the latter being particularly preferable. When two or more oils are used, they are adequately mixed to have a kinematic viscosity of 20 to 52 $mm^2/s$ at 100° C., preferably 20 to 40 $mm^2/s$. The preferable high-viscosity base oil is a hydrocarbon-based synthetic oil, in particular ethylene-α-olefin copolymer or poly-α-olefin.

Next, additives useful for the gear oil composition of the present invention are described.

It is essential for the gear oil composition of the present invention to have high load resistance characteristics as a gear oil for vehicle driving systems. It is particularly required to form/retain a thick oil film between gears for a hypoid gear of final reduction gear, and is hence incorporated with a sulfur-based additive as an extreme-pressure agent and/or phosphorus-based additive as a wear resistance improver to further improve load resistance characteristics by keeping extreme-pressure performance.

The sulfur-based additives useful for the present invention include those containing at least one species of sulfur compound, selected from hydrocarbon sulfide and sulfided oil/fat compounds, represented by sulfided olefins.

The hydrocarbon sulfide compounds include the sulfur compounds represented by the general formula (1):

$$R_1—S_x—R_2 \quad (1)$$

In the general formula (1), $R_1$ and $R_2$ are each a linear or cyclic hydrocarbon group, and may be the same or different. Each may be a linear or branched alkyl group of 1 to 20 carbon atoms; linear or branched alkenyl group of 2 to 20 carbon atoms; aromatic group of 6 to 26 carbon atoms; or alicyclic group of 3 to 26 carbon atoms, for example. The aromatic group may be substituted with an alkyl or alkenyl group of 4 to 12 carbon atoms. The preferable hydrocarbon groups include alkyl and alkenyl groups of 4 to 12 carbon atoms. More specifically, the alkyl groups include butyl, pentyl, hexyl, heptyl, octyl, nonyl, decyl, undecyl, dodecyl and a branched isomer thereof. The alkenyl groups include butenyl, pentenyl, hexenyl, heptenyl, octenyl, nonenyl, decenyl, undecenyl, dodecenyl and a branched isomer thereof.

In the general formula (1), "x" is an integer of 1 or more, preferably 2 or more. Those represented by the general formula (1) include mono-, di-, tri- and poly-sulfide compounds.

Accordingly, the preferable compounds represented by the general formula (1) include dialkyl polysulfides and dialkenyl polysulfides. More specifically, diisobutyl disulfide, diisobutyl polysulfide, dihexyl polysulfide, dioctyl polysulfide, di-t-nonyl polysulfide, didecyl polysulfide, didodecyl polysulfide, diisobutylene polysulfide, dioctenyl polysulfide and dibenzyl polysulfide, of which more preferable ones are sulfided olefins (e.g., diisobutyl polysulfide). A sulfided olefin can be produced by sulfiding an olefin, e.g., polyisobutylene, in the presence of a sulfiding agent. The preferable polysulfides for the gear oil composition of the present invention include those containing elementary sulfur at 1 to 5% by mass, more preferably 1.5 to 3% by mass based on the whole gear oil composition.

Sulfided oils/fats include a product by reaction between an oil/fat and sulfur, containing elementary sulfur at 5 to 20% by mass.

The sulfur-based additive is incorporated at 1 to 5% by mass as elementary sulfur on the whole gear oil composition, particularly preferably 1.5 to 3% by mass.

The phosphorus-based additives useful for the present invention include a phosphate ester, phosphite ester, acidic phosphate ester, acidic phosphite ester and amine salt thereof. At least one species selected from the above compounds may be incorporated.

The phosphate esters can be represented by, for example, the general formula (2):

$$(R^1O)_mP(=O)(OH)_{3-m} \quad (2)$$

The phosphite acid esters can be represented by the general formula (3):

$$(R^2O)_nP(OH)_{3-n} \quad (3)$$

In the general formulae (2) and (3), $R^1$ and $R^2$ are each a hydrocarbon group, preferably alkyl, alkenyl, aryl or alkylaryl group of 1 or more, preferably 4 or more, particularly preferably 4 to 20 carbon atoms. $R^1$ and $R^2$ may be the same or different. The alkyl and alkenyl groups may be linear or branched. In these formulae, "m" and "n" are each an integer of 1, 2 or 3. A plurality of $R^1$s may be the same or different, and so are $R^2$s.

Oleyl acid phosphate [a mixture of $(C_{18}H_{35}O)P(OH)_2O$ and $(C_{18}H_{35}O)_2P(OH)O$] and dioleyl hydrogen phosphite $[(C_{18}H_{35}O)_2P(OH)]$ can be cited as representative acidic phosphate ester and acidic phosphite ester, respectively.

An alkylamine salt of acidic phosphate ester is a product by reaction between an acidic phosphate ester and alkylamine, represented by, for example, the general formula (4):

$$(R^4O)_m\overset{\overset{\displaystyle O}{\|}}{P}(OH)_{3-m}\cdot(NH_nR^6_{3-p})_{3-m} \quad (4)$$

An alkylamine salt of acidic phosphite ester is represented by, for example, the general formula (5):

$$(R^5O)_nP(OH)_{3-n}\cdot(NH_pR^7_{3-p})_{3-n} \quad (5)$$

In the general formulae (4) and (5), $R^4$ and $R^5$ are each a hydrocarbon group, preferably alkyl, alkenyl, aryl or alkylaryl group of 1 or more, particularly preferably 4 to 20 carbon atoms. The alkyl and alkenyl groups may be linear, branched or cyclic. $R^6$ and $R^7$ are each a hydrocarbon group, preferably alkyl, alkenyl, aryl or alkylaryl group of 1 or more, particularly preferably 4 to 20 carbon atoms. The alkyl and alkenyl groups may be linear, branched or cyclic. When a plurality of $R^4$s are present, they may be the same or different, and so are $R^5$s to $R^7$s, when present.

In the general formulae (4) and (5), $R^4$ to $R^7$ are each butyl, hexyl, cyclohexyl, octyl, 2-ethylhexyl, decyl, lauryl, myristyl, palmityl, stearyl, oleyl or eicosyl, among others.

Acidic phosphate ester and amine salt of acidic phosphate ester are particularly preferable for the gear oil composition of the present invention.

Diisooctyl acid phosphate/oleyl amine salt [product of reaction between $(i\text{-}C_8H_{17}O)_2P(OH)O$ and $(C_{18}H_{35})NH$] and di-9-octadecenyl acid phosphate/oleylamine salt can be cited as representative alkylamine salts of acidic phosphate ester.

These phosphorus-based additives may be used either individually or in combination. The additive(s) is/are incorporated at 0.05 to 0.3% by mass as phosphorus on the whole gear oil composition, preferably 0.1 to 0.25% by mass.

The phosphorus-based additive exhibits a high wear inhibiting effect and also works as an aid for promoting the effect of the sulfur-based additive as an extreme-pressure additive. The amine salts of acidic phosphate and acidic phosphite esters exhibit particularly high wear inhibiting effects.

The gear oil composition of the present invention may be incorporated with an ester as a solubilizing agent. The esters useful for the present invention include esters of a dibasic acid (e.g., phthalic, succinic, alkylsuccinic, alkenylsuccinic, maleic, azelaic, suberic, sebacic, fumaric or adipic acid, or linolic acid dimmer) and alcohol (e.g., butyl, hexyl, 2-ethylhexyl, dodecyl alcohol, ethylene glycol, diethylene glycol monoether or propylene glycol); and esters of a monocarboxylic acid of 5 to 18 carbon atoms and polyol (e.g., neopentyl glycol, trimethylolpropane, pentaerythritol, dipentaerythritol or tripentaerythritol). Other compounds useful as a solubilizing agent include polyoxyalkylene glycol, polyoxyalkylene glycol ester, polyoxyalkylene glycol ether and phosphate ester. The solubilizing agent may be incorporated at 10 to 25% by mass on the whole gear oil composition, preferably 14 to 22% by weight.

The gear oil composition of the present invention may be adequately incorporated with one or more commonly used additives in addition to the above, as required, within limits not harmful to the object of the present invention.

More specifically, the gear oil composition may be further incorporated with one or more additives adequately selected from an ashless dispersant, pour point depressant, antifoaming agent, antioxidant, rust inhibitor, friction modifier and so forth in order to satisfy diversified characteristics, e.g., those related to friction, oxidation stability, cleanness and defoaming in addition to the viscosity characteristics already described above. It is not necessarily incorporated with a viscosity index improver, which is one of the peculiar characteristics of the present invention. However, it may be incorporated at an adequate content, when the composition has sufficient stability against shear stress not to deteriorate bearing fatigue life.

The ashless dispersants useful for the present invention include those based on polybutenyl succinic acid imide, polybutenyl succinic acid amide, benzylamine, succinic acid ester, succinic acid ester-amide and a boron derivative thereof. The ashless dispersant is incorporated normally at 0.05 to 7% by mass.

The metallic detergent may be selected from those containing a sulfonate, phenate, salicylate of calcium, magnesium, barium or the like. It may be optionally selected from perbasic, basic, neutral salts and so forth of different acid value. The metallic detergent is incorporated normally at 0.05 to 5% by mass.

The pour point depressants useful for the present invention include ethylene/vinyl acetate copolymer, condensate of chlorinated paraffin and naphthalene, condensate of chlorinated paraffin and phenol, polymethacrylate, polyalkyl styrene and so forth. The pour point depressant is incorporated normally at 0.1 to 10% by weight.

The defoaming agents which can be used for the present invention include dimethyl polysiloxane, polyacrylate and a fluorine derivative thereof, and poerfluoropolyether. The defoaming agent may be incorporated normally at 10 to 100 ppm by mass.

The antioxidants which can be used for the present invention include amine-based ones, e.g., alkylated diphenylamine, phenyl-α-naphtylamine and alkylated phenyl-x-naphtylamine; phenol-based ones, e.g., 2,6-di-t-butyl phenol, 4,4'-methylenebis-(2,6-di-t-butyl phenol) and isooctyl-3-(3,5-di-t-butyl-4-hydroxyphenyl)propionate; sulfur-based ones, e.g., dilauryl-3,3'-thiodipropionate; and zinc dithiophosphate. The antioxidant is incorporated normally at 0.05 to 5% by mass.

The rust inhibitors useful for the present invention include a fatty acid, alkenylsuccinic acid half ester, fatty acid soap, alkylsulfonate, polyhydric alcohol/fatty acid ester, fatty acid amine, oxidized paraffin and alkylpolyoxyethylene ether. The rust inhibitor is incorporated normally at 0 to 37% by mass.

The friction modifiers useful for the present invention include an organomolybdenum-based compound, fatty acid, higher alcohol, fatty acid ester, oil/fat, amine, polyamide, sulfided ester, phosphoric acid ester, acid phosphoric acid ester, acid phosphorous acid ester and amine salt of phosphoric acid ester. The friction modifier is incorporated normally at 0.05 to 5 by mass.

A total content of additive(s) in the gear oil composition of the present invention is not limited. However, one or more additives (including the above-described solubilizing agent) may be incorporated at 10 to 30% by mass, preferably 15 to 25% by mass.

As described above, the gear oil composition of the present invention is composed of (A) a low-viscosity base oil, (B) a high-viscosity base oil, and (C) one or more additives for gear oil as required, where these components (A), (B) and (C) are incorporated in a controlled ratio to have a composition kinematic viscosity not exceeding 80 $mm^2/s$ at 40° C.

The present invention provides a gear oil composition, in particular that for final reduction gears. It can be also used for manual transmissions (MTs) and manual accelerators (MTXs) as a lubricating oil for vehicle driving systems. Therefore, it can serve as a common lubricant for reduction gears, MTs and MTXs.

EXAMPLES

The present invention is described in detail by EXAMPLES and COMPARATIVE EXAMPLES, which by no means limit the present invention.

In EXAMPLES, ethylene-propylene oligomer was used as the ethylene-α-olefin copolymer (EAO), and α-olefin oligomer mainly composed of decene was used as the poly-α-olefin copolymer (PAO). In EXAMPLES, "%" means "% by mass."

The method for measuring kinematic viscosity and that for evaluating bearing fatigue life characteristics are described below.

Measurement of Kinematic Viscosity

Kinematic viscosity at 40° C. (KV40° C.) and that at 100° C. (KV100° C.) were measured in accordance with ASTM D445.

Evaluation of Bearing Fatigue Life Characteristics

An oil film formed between a disk and roller was observed by a light interference method using a fluid film analyzer and analyzing procedure described in Tribology Transactions, 39, (3), 720 to 725 (1996) under the following conditions. FIG. 1 illustrates the analyzing procedure.

Oil film temperature: 23° C.

Circumferential velocity: 0.2 m/s

Plane pressure (average Hertz pressure): 0.6 GPa

Mileage Test

The test was carried out using an SUV vehicle in the LA#+highway mode.

Example 1

A mixture of 11% of a refined mineral oil having a kinematic viscosity of 6.5 $mm^2/s$ at 100° C. and 61% of an ethylene-α-olefin copolymer (EAO) having a kinematic viscosity of 20 $mm^2/s$ at 100° C. was incorporated with 18% of diisodecyladipate (DIDA), 5% of a sulfided olefin, 3% of an amine salt of acidic phosphate ester and 2% of other additives, to prepare Sample Oil (a). It had a kinematic viscosity of 73.4 $mm^2/s$ at 40° C., and passed the fuel saving criterion. It also passed the bearing fatigue life criterion, because it produced a 138 μm thick oil film.

Example 2

A mixture of 26% of a poly-α-olefin copolymer (PAO) having a kinematic viscosity of 4.1 $mm^2/s$ at 100° C., 46% of an ethylene-α-olefin copolymer (EAO) having a kinematic viscosity of 40 $mm^2/s$ at 100° C., 18% of diisodecyladipate (DIDA), 5% of a sulfided olefin, 3% of an amine salt of acidic phosphate ester and 2% of other additives was prepared as Sample Oil (b). The evaluation results of Sample (b) with respect to fuel saving and bearing fatigue characteristics are given in Table 1.

Example 3

A mixture of 30% of a poly-α-olefin copolymer (PAO) having a kinematic viscosity of 5.8 $mm^2/s$ at 100° C. and 42% of a poly-α-olefin copolymer (PAO) having a kinematic viscosity of 40 $mm^2/s$ at 100° C. was incorporated with 18% of diisodecyladipate (DIDA), 5% of a sulfided olefin, 3% of an amine salt of acidic phosphate ester and 2% of other additives to prepare Sample Oil (c). The evaluation results of Sample Oil (c) with respect to fuel saving and bearing fatigue characteristics are given in Table 1.

Example 4

A mixture of 35% of a refined mineral oil having a kinematic viscosity of 6.5 $mm^2/s$ at 100° C. and 37% of a poly-α-olefin copolymer (PAO) having a kinematic viscosity of 40 $mm^2/s$ at 100° C. was incorporated with 18% of diisodecyladipate (DIDA), 5% of a sulfided olefin, 3% of an amine salt of acidic phosphate ester and 2% of other additives, to prepare Sample Oil (d). It had a kinematic viscosity of 73.4 $mm^2/s$ at 40° C., and passed the fuel saving criterion. The evaluation results of Sample Oil (d) with respect to fuel saving and bearing fatigue characteristics are given in Table 1.

Example 5

A mixture of 39% of a refined mineral oil having a kinematic viscosity of 6.5 $mm^2/s$ at 100° C. and 33% of a poly- α-olefin copolymer (PAO) having a kinematic viscosity of 50 $mm^2/s$ at 100° C. was incorporated with 18% of diisodecyladipate (DIDA), 5% of a sulfided olefin, 3% of an amine salt of acidic phosphate ester and 2% of other additives, to prepare Sample Oil (e). The evaluation results of Sample Oil (e) with respect to fuel saving and bearing fatigue characteristics are given in Table 1.

Example 6

Sample Oil (d) prepared in EXAMPLE 4 as a representative oil composition of the present invention and a commercial gear oil (Toyota, Junsei Hypoid Gear Oil SX, 85W90) were tested in accordance with the above-described procedure to evaluate their fuel saving characteristics. It is confirmed that Sample Oil (d) saves fuel consumption by 1.0% or more.

Comparative Example 1

A mixture of 41% of a refined mineral oil having a kinematic viscosity of 6.5 $mm^2/s$ at 100° C. and 31 of a mixture of an ethylene-α-olefin copolymer (EAO) and poly-α-olefin copolymer (PAO) having a kinematic viscosity of 60 $mm^2/s$ at 100° C. was incorporated with 18% of diisodecyladipate (DIDA), 5% of a sulfided olefin, 3% of an amine salt of acidic phosphate ester and 2% of other additives, to prepare Sample Oil (aa). The evaluation results of Sample Oil (aa) with respect to fuel saving and bearing fatigue characteristics are given in Table 1.

Comparative Example 2

A mixture of 45% of a refined mineral oil having a kinematic viscosity of 6.5 $mm^2/s$ at 100° C. and 27 of a poly-α-olefin copolymer (PAO) having a kinematic viscosity of 103 $mm^2/s$ at 100° C. was incorporated with 18% of diisodecyladipate (DIDA), 5% of a sulfided olefin, 3% of an amine salt of acidic phosphate ester and 2% of other additives, to prepare Sample Oil (bb). The evaluation results of Sample Oil (bb) with respect to fuel saving and bearing fatigue characteristics are given in Table 1.

Comparative Example 3

A mixture of 72% of a poly-α-olefin copolymer (PAO) having a kinematic viscosity of 16 $mm^2/s$ at 100° C., 18% of diisodecyladipate (DIDA), 5% of a sulfided olefin, 3% of an amine salt of acidic phosphate ester and 2% of other additives was prepared as Sample Oil (cc). The evaluation results of Sample Oil (cc) with respect to fuel saving and bearing fatigue characteristics are given in Table 1.

Comparative Example 4

A commercial gear oil for final reduction gears (API service classification: GL-5, SAE viscosity grade: 75W90) was tested for fuel saving and bearing fatigue characteristics. The evaluation results are given in Table 1.

Each of Sample Oils (a), (d) and (e), prepared in respective EXAMPLES 1, 4 and 5, was composed of the low-viscosity base oil having a kinematic viscosity of 6.5 $mm^2/s$ at 100° C., and the high-viscosity base oil having a respective kinematic viscosity of 20, 40 and 50 $mm^2/s$ at 100° C., and passed both the fuel saving and bearing fatigue criteria.

Moreover, Sample Oil (a) prepared in EXAMPLE 1 comprised the high-viscosity base oil (EAO) having a kinematic viscosity which represents the lower limit (20 $mm^2/s$ at 100° C.) of the effective viscosity range for the present invention. On the other hand, Sample Oil (e) prepared in EXAMPLE 5 comprised the high-viscosity base oil (PAO) having a kinematic viscosity which represents the upper limit of the effective viscosity range for the present invention.

Sample Oils (aa) and (bb) prepared in respective COMPARATIVE EXAMPLES 1 and 2 comprised the high-viscosity base oil having a respective kinematic viscosity of 60 and 103 $mm^2/s$ at 100° C., which are beyond the effective viscosity range for the present invention (20 to 52 $mm^2/s$). They passed the fuel saving criterion, but failed to pass the bearing fatigue criterion, exhibiting a peculiar phenomenon that deteriorated bearing fatigue characteristics result when a kinematic viscosity of high-viscosity base oil deviates from a specific range of viscosity measured at 100° C.

Sample Oil (cc) prepared in COMPARATIVE EXAMPLE 3 comprised a poly-α-olefin copolymer having a kinematic viscosity of 16 $mm^2/s$ at 100° C. as the sole base oil. It deviates from the technical concept of the present invention, which uses at least 2 species of base oils, a low-viscosity and high-viscosity oils.

The results of COMPARATIVE EXAMPLE 3 indicate that a gear oil comprising only one species of base oil cannot bring sufficient effects could be obtained when at least 2 species of base oil are used, even when they have the same level of kinematic viscosity measured at 40° C.

The commercial product tested failed to pass the fuel saving criterion and had bearing fatigue characteristics not necessarily sufficient.

As described above, it is confirmed that a gear oil composition comprising a low-viscosity and high-viscosity base oils, each having a specific viscosity, can simultaneously satisfy fuel saving effect and bearing fatigue life characteristics. It is demonstrated that the gear oil composition of the present invention can form an oil film having a thickness exceeding 132 μm, which is thicker than an oil film which a commercial product of highest quality can give, and also exhibits notably improved bearing fatigue characteristics.

TABLE 1

| Compositions | | 1<br>Ex. 1<br>Sample oil a | 2<br>Ex. 2<br>Sample oil b | 3<br>Ex. 3<br>Sample oil c | 4<br>Ex. 4<br>Sample oil d | 5<br>Ex. 5<br>Sample oil e | 6<br>Comp. Ex. 1<br>Sample oil aa | 7<br>Comp. Ex. 2<br>Sample oil bb | 8<br>Comp. Ex. 3<br>Sample oil cc | 9<br>Comp. Ex. 4 |
|---|---|---|---|---|---|---|---|---|---|---|
| Base oils | Kin. Vis. @100° C. ($mm^2/s$) | | | | | | | | | Commercial lubricating oil for final |

TABLE 1-continued

| Compositions | | 1 Ex. 1 Sample oil a | 2 Ex. 2 Sample oil b | 3 Ex. 3 Sample oil c | 4 Ex. 4 Sample oil d | 5 Ex. 5 Sample oil e | 6 Comp. Ex. 1 Sample oil aa | 7 Comp. Ex. 2 Sample oil bb | 8 Comp. Ex. 3 Sample oil cc | 9 Comp. Ex. 4 |
|---|---|---|---|---|---|---|---|---|---|---|
| Low-vis. base oil (PAO)[note3)] | 4.1 | — | 26 | — | — | — | — | — | — | reduction gears[Note1)] |
| Low-vis. base oil (PAO) | 5.8 | — | — | 30 | — | — | — | — | — | |
| Low-vis. base oil (Mineral oil)[note3)] | 6.5 | 11 | — | — | 35 | 39 | 41 | 45 | — | |
| High-vis. base oil (PAO) | 16 | — | — | — | — | — | — | — | 72 | |
| High-vis. base oil (EAO)[note3)] | 20 | 61 | — | — | — | — | — | — | — | |
| High-vis. base oil (EAO) | 40 | — | 46 | — | — | — | — | — | — | |
| High-vis. base oil (PAO) | 40 | — | — | 42 | 37 | — | — | — | — | |
| High-vis. base oil (PAO) | 50 | — | — | — | — | 33 | — | — | — | |
| High-vis. base oil (PAO) | 60 | — | — | — | — | — | 31 | — | — | |
| High-vis. base oil (PAO) | 103 | — | — | — | — | — | — | 27 | — | |
| Additives | | | | | | | | | | |
| Sulfided olefin | | 5 | 5 | 5 | 5 | 5 | 5 | 5 | 5 | |
| Amine salt of acidic phosphate ester (semi-neutralized product) | | 3 | 3 | 3 | 3 | 3 | 3 | 3 | 3 | |
| Diisodecyladipate (DIDA) | | 18 | 18 | 18 | 18 | 18 | 18 | 18 | 18 | |
| Other additives[Note2)] | | 2 | 2 | 2 | 2 | 2 | 2 | 2 | 2 | |
| Evaluation results | | | | | | | | | | |
| Fuel saving effect[Note11)] | | | | | | | | | | |
| Evaluation | | Passed | Passed | Passed | Passed | Passed | Passed | Passed | Passed | Not passed |
| Kin. vis. @40° C. ($mm^2/s$) | | 73.4 | 73.1 | 73.0 | 73.5 | 73.0 | 72.7 | 73.4 | 67.7 | 89.1 |
| Bearing fatigue characteristics[Note12)] | | | | | | | | | | |
| Evaluation | | Passed | Passed | Passed | Passed | Passed | Not passed | Not passed | Not passed | Passed |
| Oil film thickness (mm) | | 138 | 137 | 136 | 136 | 133 | 130 | 122 | 131 | 132 |

[Note1)] Commercial lubricating oil for final reduction gears (GL-5, 75W90)
[Note2)] Other additives: silicone compound, polymethacrylate and succinimide
[note3)] Mineral oil: solvent-refined mineral oil
PAO: Poly-α-olefin
EAO: Ethylene-α-olefin copolymer
[Note11)] Fuel saving criterion: Kinematic viscosity of 80 $mm^2/s$ at 40° C.
[Note12)] Bearing fatigue life criterion: Oil film thickness of 132 nm or more

BRIEF DESCRIPTION OF THE DRAWINGS

FIG. 1 illustrates a system for analyzing oil film, based on light interference

DESCRIPTION OF SYMBOLS

1. Roller
2. Disk
3. Oil film thickness
4. Incident light
5. Light reflected by the disk surface
6. Light reflected by the roller surface
7. Sample oil

What is claimed is:

1. A gear oil composition exhibiting improved fuel-savings effect and bearing fatigue life characteristics comprising:

a first base oil comprising a mineral-based oil or a hydrocarbon-based synthetic oil selected from a poly-α-olefin, wherein said mineral-based oil and said hydrocarbon-based synthetic oil have a kinematic viscosity of 3.5 to 7 $mm^2/s$ at 100° C., a second base oil comprising a hydrocarbon-based synthetic oil having a kinematic viscosity of 20 to 52 $mm^2/s$ at 100° C., wherein the difference in the viscosity of the first base oil and the second base oil is at least 13 $mm^2/s$ and no more than 48.5 $mm^2/s$, wherein the second base oil is a poly-α-olefin or an ethylene-α-olefin copolymer, and a sulfur-based additive incorporated at 1 to 5% by mass as elementary sulfur on the whole gear oil composition, wherein the gear oil composition has a kinematic viscosity of 70 to 80 $mm^2/s$ at 40° C., and is essentially free of viscosity index modifying additives, wherein the first base oil is present in the amount of 11 to 39% by mass and the second base oil is present in the amount of 33 to 61% by mass with the total of the first base oil and the second base oil being about 72% by mass of the gear oil composition, wherein the sulfur-based additive is a sulfided olefin, and wherein the kinematic viscosity at 40 deg. C. for measuring fuel-saving effect is less than or equal to 73.4 $mm^2/s$ and the oil film thickness for measuring bearing fatigue life is greater than or equal to 133 mm for the gear oil composition.

2. The gear oil composition according to claim 1, further comprising and at least one species of additive selected from the group consisting of phosphorus-based extreme pressure additive, solubilizing agent, ashless dispersant, pour point depressant, antifoaming agent, antioxidant, rust inhibitor, corrosion inhibitor and friction modifier.

3. The gear oil composition according to claim 2, wherein the sulfur-based additive is a sulfided olefin, and phosphorus-based additive is an amine salt of acidic phosphate ester or acidic phosphite ester.

4. The gear oil composition according to claim 2, wherein the solubilizing agent is an ester.

5. The gear oil composition according to claim 1 which is for vehicle final reduction gears.

6. A method for reducing fuel consumption at vehicle final reduction gears for which the gear oil composition according to claim 1 is used for lubrication.

7. The gear oil composition of claim 3 wherein the additives further comprise a pour point depressant comprising at least 0.1 and no more than 10 mass weight percent of the composition, a defoamant agent of at least 10 ppm and no more than 100 ppm of the composition, a metallic detergent selected from the group consisting of sulfonate, phenate, salicyclate, and any combination thereof, the metallic detergent comprising at least 0.5 and no more than 5 mass weight percent of the composition, an antioxidant of at least 0.5 and no more than 5 mass percent of the composition, the phosphorus-based additive comprising at least 0.1 and no more than 0.25 mass weight percent of the composition, and an ester as a solubilizing agent, the ester comprising at least 10 and no more than 25 mass weight percent of the composition.

8. The gear oil composition of claim 7 wherein the ester used as a solubilizing agent is a diisodecyladipate (DIDA).

9. The gear oil composition of claim 1 wherein the second base stock is a poly-α-olefin.

* * * * *